United States Patent [19]

Lührsen

[11] 4,203,538

[45] May 20, 1980

[54] REFRACTORY SPOUT BRICK

[75] Inventor: Ernst Lührsen, Bad Schwalbach, Fed. Rep. of Germany

[73] Assignee: Didier-Werke AG, Wiesbaden, Fed. Rep. of Germany

[21] Appl. No.: 922,427

[22] Filed: Jul. 6, 1978

[30] Foreign Application Priority Data

Jul. 9, 1977 [DE] Fed. Rep. of Germany ..... 2731113

[51] Int. Cl.[2] ..... B22D 41/08

[52] U.S. Cl. ..... 222/603; 164/66

[58] Field of Search ..... 222/590, 591, 603, 148; 164/66, 437

[56] References Cited

U.S. PATENT DOCUMENTS

| | | | |
|---|---|---|---|
| 3,253,307 | 5/1966 | Griffiths et al. | 222/603 X |
| 4,042,007 | 8/1977 | Zavavas | 164/437 X |
| 4,091,971 | 5/1978 | Tinnes et al. | 222/603 |

FOREIGN PATENT DOCUMENTS

| | | | |
|---|---|---|---|
| 6918019 | 5/1969 | Fed. Rep. of Germany . | |
| 2012691 | 10/1970 | Fed. Rep. of Germany . | |
| 834234 | 5/1960 | United Kingdom | 222/603 |

*Primary Examiner*—David A. Scherbel

*Attorney, Agent, or Firm*—Wenderoth, Lind & Ponack

[57] ABSTRACT

A block of refractory material has extending therethrough a throughflow opening, preferably including a funnel-shaped inlet converging inwardly to a throughflow duct. An annular gas collecting space is provided within the block at a position surrounding the throughflow opening radially outwardly thereof. A gas feed duct extends through the block from the exterior thereof to the gas collecting space. At least one annular duct extends radially inwardly from the gas collecting space to the throughflow opening. The annular duct opens into and forms with the throughflow opening at least one narrow slit which extends around the entire periphery of the throughflow opening.

14 Claims, 9 Drawing Figures

REFRACTORY SPOUT BRICK

BACKGROUND OF THE INVENTION

The present invention relates to a refractory spout brick of the type which is molded from a refractory material, preferably a ceramic refractory material, and which has extending therethrough a throughflow opening in the form of a funnel-shaped inlet converging inwardly and downwardly to a throughflow duct.

Spout bricks of this general type are well known in the metallurgy art and are employed for a diverse number of operations wherein it is necessary to pour molten material, such as molten metal, from a container.

The present invention is further directed to such a refractory spout brick of the type further including a gas collecting space surrounding the throughflow duct, with a gas feed duct extending from the exterior to the gas collecting space, and with a lateral gas feed extending from the gas collecting space to the throughflow duct. Spout bricks of this general type are used, for example in continuous casting operations, particularly for the continuous casting of aluminum-killed steel.

The lateral feed of gas to the throughflow duct is variously employed for preventing the formation of deposits in the throughflow duct, and/or preventing the freezing of the melt when a slide closure is closed, and/or regulating the throughflow velocity of the metal melt, and/or metallurgically treating the metal melt.

Considerable effort has been made in the prior art to achieving efficient systems for laterally feeding gas to the throughflow duct of a spout brick.

In German DT-OS No. 20 12 691, there is shown a system wherein gas is flowed into a throughflow duct through the material of the spout brick itself, which is thus made permeable to gas, for the purposes of avoiding obstruction and narrowing down of the throughflow duct, as well as to avoid soiling of the throughflow duct. However, the arrangement of this German publication is disadvantageous in practice.

In U.S. Pat. No. 3,253,307, there is shown a system wherein gas is conducted to the throughflow duct from an annular duct which surrounds the throughflow duct through a plurality of radial inlet ducts, for the purpose of controlling the throughflow velocity of the metal melt. This arrangement is disadvantageous in operation. This U.S. patent also discloses permeating a gas laterally inwardly through an annular ceramic element. This arrangement does not however provide the necessary distribution, direction and velocity of the gas, since the gas merely bubbles through the relatively porous ceramic element. Additionally, sealing problems occur.

German Gebrauchmuster No. 69 18 019 discloses an arrangement wherein oxygen is blown through a radial duct into a throughflow duct to obtain a metallurgical treatment of steel, specifically a concentration of oxygen in the molten metal. This German disclosure also employs an oxygen duct which opens tangentially into the throughflow duct and which may be directed obliquely downwardly. This arrangement does not however result in entirely satisfactory results.

From the above discussion, it is believed that it will be apparent that the manufacture of known spout bricks is complex, particularly with regard to the provision of a system for supplying gas through the brick to the throughflow duct.

SUMMARY OF THE INVENTION

With the above discussion in mind, it is a principle object of the present invention to provide a refractory spout brick of the above discussed type which can be manufactured easily and economically.

It is a further object of the present invention to provide such a refractory spout brick whereby it is possible to inject into the throughflow opening extending therethrough a supply of gas so that it is possible to efficiently and accurately prevent the formation of deposits in the throughflow opening, prevent freezing of the melt, regulate the throughflow velocity of the melt, and subject the melt to a metallurgical treatment.

It is another principle object of the present invention to provide an improved process for the manufacture of such refractory spout brick.

The above objects are achieved in accordance with the present invention by the provision of a refractory spout brick including a block of refractory material having extending therethrough a throughflow opening including a funnel-shaped inlet converging inwardly and downwardly to a throughflow duct. An annular gas collecting space is provided within the block at a position surrounding the throughflow duct radially outwardly thereof. A gas feed duct extends through the block, from the exterior thereof, to the gas collecting space. At least one annular duct extends radially inwardly from the gas collecting space to the throughflow opening. This annular duct opens into and forms with the throughflow opening at least one slit which extends around th entire periphery of the throughflow opening.

By the provision of this structural arrangement, a gas may be fed through the gas feed duct into the gas collecting space. The pressure of the gas will build up within the gas collecting space, and this buildup of pressure will ensure that there will be a uniform flow of the gas through the annular duct and into the throughflow opening, and that this uniform flow will be around the entire periphery of the throughflow opening. Thus, the supply of gas to the throughflow opening will be completely uniform around the entire periphery of the throughflow opening, and the pressure of this peripheral supply of gas may be maintained at a desired relatively high rate. This effect is further intensified due to the fact that the liquid metal melt will be flowing at a relatively rapid rate through the throughflow opening and past the annular slit, thereby tending to produce a vacuum in the annular slit, such vacuum further drawing the gas out of the annular duct around the entire periphery of the throughflow opening.

In the above simple but effective manner it is possible to efficiently and accurately employ the supply of gas to prevent the formation of deposits, prevent freezing of the melt, regulate the throughflow velocity of the melt, and subject the melt to a desired metallurgical treatment.

The effect of the gas feed in accordance with the present invention can be still further intensified by increasing the quantity of the gas supplied to the gas feed duct and/or by providing further annular ducts which open into the throughflow opening in the form of a slit which extends peripherally around the entire throughflow opening. Such additional slits would be axially spaced from the first slit along the length of the throughflow opening. It has been found that the above factors may be efficiently and accurately achieved and controlled when the axial dimension or width of the slit is less than 1 mm, with a resultant unexpectedly low consumption of gas. The specific slot width will vary from installation to installation and will be determined in accordance with various factors, including the particular gas employed, the diameter of the throughflow duct, the specific metal melt involved, etc.

The most basic form of the present invention includes a single annular duct extending substantially transversely of the throughflow duct and opening thereinto in the form of a single peripheral slit. It has however been found advantageous in certain instances to increase the effectiveness of the supply of gas by providing an annular duct which extends from the gas collecting space to the throughflow duct in an obliquely and downwardly direction. Such oblique annular duct opens into the throughflow duct in the form of a peripheral slit extending entirely around the periphery of the throughflow duct. Such oblique annular duct and the resultant slit opening thereof may be provided in addition to or as an alternative of an annular duct extending transversely of the throughflow duct. In addition, in certain instances it has been found desirable to provide an annular duct which extends from the gas collecting space and which opens into the funnel-shaped inlet in the form of a peripheral slit which extends entirely around the funnel-shaped inlet. Such annular duct extending to and opening into the funnel-shaped inlet may be provided in addition to or as an alternative of the above described transversely and/or obliquely extending annular ducts.

In one specific preferred embodiment of the present invention, the gas collecting space is in the form of a ring having a circular cross-section, and the annular duct comprises a flat peripheral duct having a width, taken substantially axially of the throughflow duct, which is less than the diameter of the ring of the gas collecting space. This width of the flat peripheral duct is substantially uniform throughout substantially the entire radial length thereof, and is approximately equal to the width of the slit, as taken axially of the throughflow duct. When this preferred structural arrangement is provided, any wear on the throughflow duct will not substantially affect the flow conditions of the gas flowing through the annular duct.

In accordance with a further embodiment of the present invention, the gas collecting space and the annular duct jointly form a peripheral duct which is approximately wedge-shaped in cross-section and which tapers radially inwardly to the throughflow opening to form the slit therewith.

In accordance with a further feature of the present invention, the gas feed duct may feed tangentially into the gas collecting space. This results in a tangential flow of the gas through the opening slit into the throughflow duct.

The present invention is also directed to a process for manufacturing the above described refractory spout brick. Specifically, the process of the present invention involves the molding of a ceramic refractory material into a desired configuration of the block to have the funnel-shaped inlet and throughflow duct extending therethrough. There is formed, from a suitable material which would be entirely burnt out during later firing of the block, for example a synthetic resin material, a core which has a configuration corresponding to the desired configuration of the annular gas collecting space, and/or the annular duct, and/or the gas feed duct. This core is molded within the ceramic refractory material during the molding of the block. Thereafter, during firing of the block, in a completely known and conventional manner, the core is completely burnt out. This results in the formation within the finished block of the annular gas collecting space of desired configuration, as well as the provision of the desired annular duct or ducts which extend from the gas collecting space and which open into the throughflow opening in the form of one or more peripheral slits which extend entirely around the periphery of the throughflow opening. It is of course to be understood that the core may be formed to be of any desired configuration of the annular gas collecting space, the annular duct or ducts, and also possibly the gas feed duct.

It is to be understood that the present invention is not directed to the specific use of any particular molten material, such as molten metal, or to the use of any particular supply gas. Rather, the present invention is directed to an improved refractory spout brick, and a process for the production thereof, adaptable for any otherwise known and conventional usages involving the discharge of a molten material through a throughflow opening and the supply of a gas to such throughflow opening for any of the above discussed conventional purposes.

Furthermore, it is not intended that the present invention be directed to the use of any particular refractory material for the formation of the refractory spout brick. Rather, it is intended that the present invention be adaptable to the use of any known refractory material, such as known ceramic refractory materials, which are used for the formation of refractory spout bricks. Additionally, it is intended that otherwise conventional molding and firing processes be employed in the present invention.

Additionally, the core which is formed during the process of the present invention may be formed of any material which is capable of being cast, molded, or otherwise formed into the desired configurations and which will thereafter entirely burn away during normal firing temperatures and conditions employed for conventionally firing refractory spout bricks. It is specifically intended that various synthetic resin materials may be employed for the formation of such cores, but other materials may similarly be employed as will be apparent to those skilled in the art.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
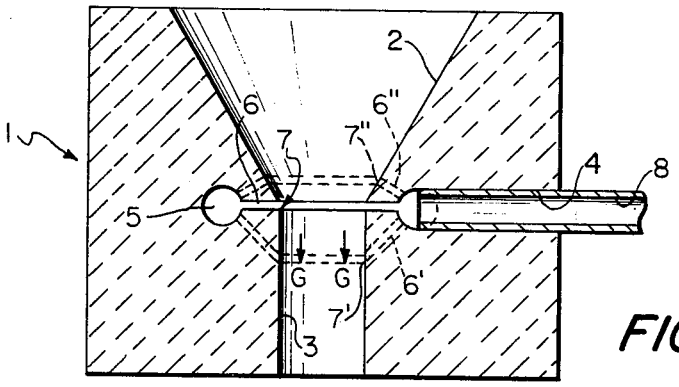
FIG. 1 is a schematic axial cross-sectional view through one embodiment of a refractory spout brick constructed in accordance with the present invention.

With reference now to FIG. 1 of the drawings, a refractory spout brick constructed in accordance with the present invention will be described in more detail. Refractory spout brick 1 is formed of a suitable material as will be understood by those skilled in the art, for example a fine granular ceramic material. Refractory spout brick 1 has extending therethrough a throughflow opening which, as is conventional, may include an upper funnel-shaped inlet 2 which converges downwardly to a generally cylindrical throughflow duct 3. The direction of flow of a molten material, such as molten metal, through the throughflow opening is indicated by arrows G.

The uppermost portion of throughflow duct 3 is radially outwardly surrounded by a gas collecting space 5, which in the embodiment of FIG. 1 is in the form of a ring having a circular cross-section. Extending radially inwardly from gas collecting space 5 is an annular duct 6 which in the illustrated embodiment is a substantially flat peripheral duct having a width, taken axially of throughflow duct 3, less than the diameter of gas collecting space 5. Annular duct 6 opens into and forms with throughflow duct 3 a peripheral slit 7 which extends around the entire periphery of throughflow duct 3.

A gas feed duct 4 extends outwardly from gas collecting space 5 to the exterior of the block of the refractory spout brick 1. A suitable gas may be supplied from a gas source (not shown) through gas feed duct 4, into gas collecting space 5, through annular duct 6, and then outwardly through peripheral slit 7 into throughflow duct 3. In the illustrated embodiment, a supply pipe 8 is shown as being sealingly fastened within gas feed duct 4, and it is intended that pipe 8 be connected to a suitable gas source.

By the above arrangement, gas is supplied from a gas source through pipe 8 and gas feed duct 4 into annular gas collecting space 5. The pressure of the gas builds up within gas collecting space 5 due to the restricted dimension of annular duct 6. The gas thus flows through annular duct 6 and slit 7 into throughflow duct 3, around the entire periphery thereof, at an increased pressure. This makes it possible to very efficiently and accurately prevent the formation of deposits in throughflow duct 3, prevent freezing of the melt in throughflow duct 3, regulate the throughflow velocity of the melt through throughflow duct 3, and subject the melt to a gaseous metallurgical treatment.

As shown in FIG. 1, annular duct 6 extends substantially transversely of throughflow duct 3. However, in certain instances it is desirous to provide an annular duct which extends obliquely of the throughflow duct 3. This is shown in FIG. 1 in phantom lines by annular duct 6′ opening into and forming with the throughflow duct 3 a peripheral slit 7′. Oblique annular duct 6′ may be provided as an alternative to transverse annular duct 6, or in addition thereto.

Additionally, in certain instances it is desirable to have an annular duct open into the funnel-shaped inlet 2. This is shown in FIG. 1 in phantom lines by the provision of annular duct 6″ opening into funnel-shaped inlet 2 as slit 7″. Additionally however, it would be possible to arrange gas collecting space 5 within the block of the refractory spout brick 1 such that transversely extending duct 6 opens into the funnel-shaped inlet 2. The arrangement of an annular duct opening into funnel-shaped inlet 2 may be employed as an alternative to the above discussed ducts opening into the throughflow duct 3, or an annular duct opening into funnel-shaped inlet 2 may be employed in addition to one or more annular ducts opening into throughflow duct 3.

Figure 3A:
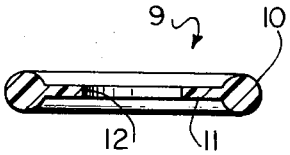
FIG. 3*a* is an axial cross-sectional view, taken along line IIIa—IIIa of FIG. 3*b*, of a further embodiment of a core which may be employed in accordance with the present invention to produce the refractory spout brick shown in FIG. 1.
Figure 3B:
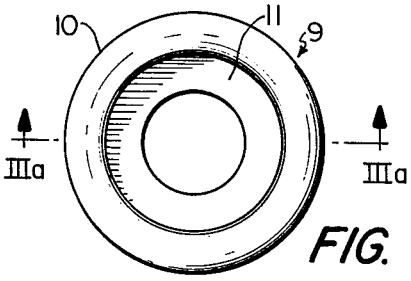
FIG. 3*b* is a plan view of the core shown in FIG. 3*a;*

In accordance with the present invention, the refractory spout brick 1 shown in FIG. 1 of the drawings is manufactured by conventionally molding a known ceramic refractory material in the desired configuration of a block having the funnel-shaped inlet 2 and the throughflow duct 3. Additionally however, a core 9, as shown in FIGS. 3*a* and 3*b* is formed in any suitable manner from a material which will completely burn out during subsequent conventional firing of the molded block of ceramic material. Core 9 includes a ring-shaped portion 10 having a circular cross-section and dimensioned to correspond in size to the desired gas collecting space 5, and an integral flat annular section 11 extending radially inwardly from ring 10 and corresponding to the desired configuration of annular duct 6. Annular portion 11 has an opening therethrough defining an edge 12. The core 9 is positioned within the molded ceramic material such that edge 12 is aligned with the throughflow duct 3 through the molded block of ceramic material to define slit 7.

Thereafter, the block of molded ceramic material is fired in a conventional manner, during which operation the core 9 is entirely burnt away, thereby forming annular gas collecting space 5, annular duct 6 and slit 7. It is to be understood that in this embodiment the gas feed duct would be supplied in any conventional and known manner.

Figure 4A:
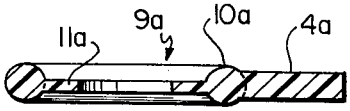
FIG. 4*a* is an axial cross-sectional view, taken along line IVa—IVa of FIG. 4*b*, of a further embodiment of a core which may be employed in accordance with the process of the present invention.
Figure 4B:
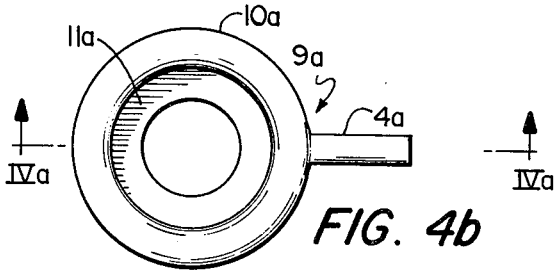
FIG. 4*b* is a plan view of the core of FIG. 4*a*.

A somewhat modified core 9*a* is shown in FIGS. 4*a* and 4*b*. Core 9*a* is the same as core 9 discussed above with regard to FIGS. 3*a* and 3*b*, with the exception that core 9*a* is also formed with a radially outwardly extending projection 4*a* which is employed to form the gas feed duct 4 within the refractory spout brick 1.

Figure 5A:
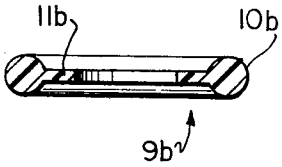
FIG. 5*a* is an axial cross-sectional view, taken along line Va—Va of FIG. 5*b*, of an even further embodiment of a core which may be employed in accordance with the process of the present invention.
Figure 5B:
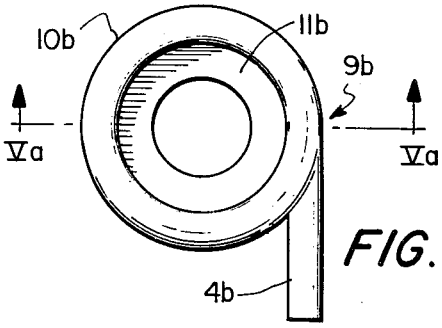
FIG. 5*b* is a plan view of the core shown in FIG. 5*a*.

The core 9*b* shown in FIGS. 5*a* and 5*b* is identical with the core 9*a* discussed above regarding FIGS. 4*a* and 4*b*, with the exception that projection 4*b* is provided to extend tangentially of ring portion 10*b*, so that the resultant formed gas feed duct 4 extends tangentially into the gas collecting space 5.

In the above described embodiments of the present invention, the annular duct 6 formed in the block of the refractory spout brick has a substantially uniform thickness or width along substantially the entire radial length thereof. Therefore, internal wear of the throughflow duct 3, or of the funnels-shaped inlet 2 will not affect the conditions of gas supply into the throughflow opening.

Figure 2A:
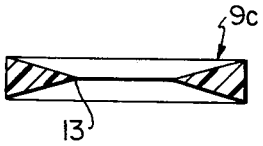
FIG. 2*a* is an axial cross-sectional view, taken along line IIa—IIa of FIG. 2*b* of one embodiment of a core which may be employed in accordance with the process of the present invention.
Figure 2B:
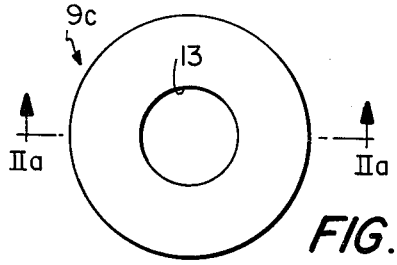
FIG. 2*b* is a plan view if a core constructed in accordance with FIG. 2*a;*

However, it is possible to form the gas collecting space and the annular duct of configurations other than those described above. More particularly, and with reference to FIGS. 2*a* and 2*b* of the drawings, a core 9*c* may have an approximately wedge-shaped cross-section which tapers radially inwardly to a peripheral edge 13. When core 9c is embedded within the molded ceramic material, peripheral edge 13 is aligned with throughflow duct 3. After firing of the molded block, the core 9c will be completely burnt away, with the result that there will be formed a gas collecting space and an annular duct which jointly form a peripheral duct which is approximately wedge-shaped in cross-section and which tapers radially inwardly to the throughflow duct 3 to form a slit therewith. It is of course to be understood that the core 9c may also be formed with projections such as 4a and 4b shown in FIGS. 4b and 5b.

It is to be further understood that in all embodiments of the cores discussed above, the cores may be modified to include additional radially inwardly extending sections such as would be used to form annular ducts 6' and 6'' shown in FIG. 1, or similarly located ducts as will be apparent to fall within the scope of the present invention as discussed hereinabove.

An additional advantage of the present invention is that due to the above described arrangements, it is possible to supply materials other than just gas to the throughflow opening. Specifically, it is possible to supply suspensions of particles to the throughflow duct 3 if desired.

Although the present invention has been illustrated and described herein with regard to specific structural arrangements and procedural operations, it will be apparent that various modifications may be made to such structural arrangements and procedural operations without departing from the scope of the present invention.

What I claim is:

1. A refractory spout brick comprising:

a block of refractory material having extending therethrough a throughflow opening;

an annular gas collecting space within said block at a position surrounding said throughflow opening radially outwardly thereof;

a gas feed duct extending through said block from the exterior thereof, to said gas collecting space; and at least one annular duct extending radially inwardly from said gas collecting space to said throughflow opening, said at least one annular duct opening into and forming with said throughflow opening at least one slit which extends around the entire periphery of said throughflow opening.

2. A refractory spout brick as claimed in claim 1, wherein said throughflow opening includes a lower throughflow duct and an upper funnel-shaped inlet converging inwardly and joining the upper end of said throughflow duct.

3. A refractory spout brick as claimed in claim 2, wherein said at least one annular duct comprises a first annular duct which opens into said throughflow duct.

4. A refractory spout brick as claimed in claim 3, wherein said first annular duct extends substantially transversely of said throughflow duct.

5. A refractory spout brick as claimed in claim 4, further comprising a second annular duct opening obliquely downwardly into said throughflow duct.

6. A refractory spout brick as claimed in claim 5, further comprising a third annular duct opening into said funnel-shaped inlet.

7. A refractory spout brick as claimed in claim 4, further comprising a second annular duct opening into said funnel-shaped inlet.

8. A refractory spout brick as claimed in claim 3, wherein said first annular duct opens obliquely downwardly into said throughflow duct.

9. A refractory spout brick as claimed in claim 8, further comprising a second annular duct opening into said funnel-shaped inlet.

10. A refractory spout brick as claimed in claim 2, wherein said annular duct opens into said funnel-shaped inlet.

11. A refractory spout brick as claimed in claim 1, wherein said gas feed duct opens tangentially into said gas collecting space.

12. A refractory spout brick as claimed in claim 11, wherein said width of said flat peripheral duct, throughout substantially the entire radial length thereof, is approximately equal to the width of said slit, taken axially of said throughflow opening.

13. A refractory spout brick as claimed in claim 1, wherein said gas collecting space is in the form of a ring having a circular cross-section, and said annular duct comprises a flat peripheral duct having a width, taken substantially axially of said throughflow opening, which is less than the diameter of said ring.

14. A refractory spout brick as claimed in claim 1, wherein said gas collecting space and said annular duct jointly form a peripheral duct which is approximately wedge-shaped in cross-section and which tapers radially inwardly to said throughflow opening to form said slit therewith.

* * * * *